US007147060B2

(12) United States Patent
Huber et al.

(10) Patent No.: US 7,147,060 B2
(45) Date of Patent: Dec. 12, 2006

(54) METHOD, SYSTEM AND APPARATUS FOR ORIENTING CASING AND LINERS

(75) Inventors: Klaus B. Huber, Sugar Land, TX (US); A. Glen Edwards, Hockley, TX (US); Luc Laverdière, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 395 days.

(21) Appl. No.: 10/440,638

(22) Filed: May 19, 2003

(65) Prior Publication Data

US 2004/0231859 A1 Nov. 25, 2004

(51) Int. Cl.
*E21B 43/119* (2006.01)

(52) U.S. Cl. ..... 166/381; 166/380; 166/50

(58) Field of Classification Search ..... 166/381, 166/380, 255.2, 78.1, 85.5, 117.7, 50; 175/4.51
See application file for complete search history.

(56) References Cited

U.S. PATENT DOCUMENTS

| | | | | |
|---|---|---|---|---|
| 3,012,608 | A | 12/1961 | McLaren | |
| 4,194,577 | A | 3/1980 | Vann | |
| 4,438,810 | A * | 3/1984 | Wilkinson | 166/66.5 |
| 4,637,478 | A * | 1/1987 | George | 175/4.51 |
| 4,869,323 | A | 9/1989 | Stagg | |
| 5,107,927 | A | 4/1992 | Whiteley et al. | |
| 5,454,430 | A | 10/1995 | Kennedy et al. | |
| 5,964,294 | A | 10/1999 | Edwards et al. | |
| 6,003,599 | A * | 12/1999 | Huber et al. | 166/255.2 |
| 6,070,667 | A | 6/2000 | Gano | |
| 6,089,320 | A | 7/2000 | LaGrange | |
| 6,199,635 | B1 | 3/2001 | Brunet et al. | |
| 6,536,531 | B1 * | 3/2003 | Brunet | 166/380 |
| 6,595,290 | B1 * | 7/2003 | George et al. | 166/297 |
| 2002/0185275 | A1 * | 12/2002 | Yang et al. | 166/297 |

FOREIGN PATENT DOCUMENTS

| | | |
|---|---|---|
| WO | WO00/75485 A1 | 12/2000 |
| WO | WO02/04782 A1 | 1/2002 |

* cited by examiner

*Primary Examiner*—Kenneth Thompson
(74) *Attorney, Agent, or Firm*—Winstead Sechrest & Minick P.C.; Kevin P. McEnaney; Jaime A. Castano

(57) ABSTRACT

A method and system are provided for installing an oriented conduit section in a well-bore having a substantially non-vertical axis. In one example, the system comprises: means for inserting a conduit a the well-bore, wherein the conduit comprises a section to be oriented, means for applying, in the well-bore, a rotating force to the section to be oriented, whereby an oriented section results, and means for fixing the conduit in the well-bore. An instrumented conduit section is also provided, for orientation in a well-bore having a substantially non-vertical axis. Further, a method is provided for using a tool in a well-bore, the method comprising: inserting a casing in the well-bore, orienting the casing in the well-bore, wherein an oriented casing is defined, inserting the tool in the oriented casing, and orienting the tool in the oriented casing.

38 Claims, 6 Drawing Sheets

METHOD, SYSTEM AND APPARATUS FOR ORIENTING CASING AND LINERS

BACKGROUND OF THE INVENTION

The present invention relates to the orientation of conduits (e.g., casings or tubings) in well-bores.

Deviations from vertical well-bores and horizontal well-bores are used in oil and gas production, and the lengths of casing and tubing strings used are quite long. Further, there is a desire for instrumentation in well-bores. However, accurate installation of instruments outside a casing or a tubing is difficult. In addition, regardless of the accuracy of installation, the ability to accurately know where an instrument resides with respect to some reference (e.g., a vertical reference) is also difficult; and, even when an instrument is not used outside the casing, it is desirable to know the location of various attributes of the casing or tubing with respect to some reference.

Various attempts to orient tools within an installed casing or tubing have been proposed. For example, see U.S. Pat. Nos.: 6,173,773; 6,089,320; 6,070,667; 6,003,599; 5,964,294; 5,454,430; 5,394,941; 5,335,724; 5,318,123; 5,285,683; 5,273,121; 5,107,927; 5,010,964; 4,637,478; 4,410,051; PCT,IB00/00754 (WO 00/75485); 4,869,323; 4,194,577, all of which are incorporated herein by reference. However, there is still a need for methods, systems, and devices, for accurate orientation of casings and/or tubings in well-bores and for accurate knowledge of the orientation of the casings and/or tubings in the well-bores.

SUMMARY

According to one example embodiment of the invention, a method is provided for installing an oriented conduit section in a well-bore having a substantially non-vertical axis. The method comprises: inserting a conduit in a the well-bore, wherein the conduit comprises a section to be oriented; applying, in the well-bore, a rotating force to the section to be oriented, whereby an oriented section results; and fixing the oriented section in well-bore.

In a further example embodiment, a system is provided for installing an oriented conduit section in a well-bore having a substantially non-vertical axis, the method comprising: means for inserting a conduit a the well-bore, wherein the conduit comprises a section to be oriented, means for applying, in the well-bore, a rotating force to the section to be oriented, whereby an oriented section results, and means for fixing the conduit in the well-bore.

In another example embodiment of the invention, an instrumented conduit section is provided for orientation in a well-bore having a substantially non-vertical axis. The conduit comprises: a substantially hollow elongated casing member comprising: a rotational axis, an inner chamber, and an instrument located outside the inner chamber, whereby an instrumented conduit section is defined; and a center of gravity of the instrumented casing that is off the rotational axis.

In a further example of the invention, a method is provided for using a tool in a well-bore, the method comprising: inserting a casing in the well-bore, orienting the casing in the well-bore, wherein an oriented casing is defined, inserting the tool in the oriented casing, and orienting the tool in the oriented casing.

DETAILED DESCRIPTION OF EXAMPLE EMBODIMENTS OF THE INVENTION

Figure 1A:
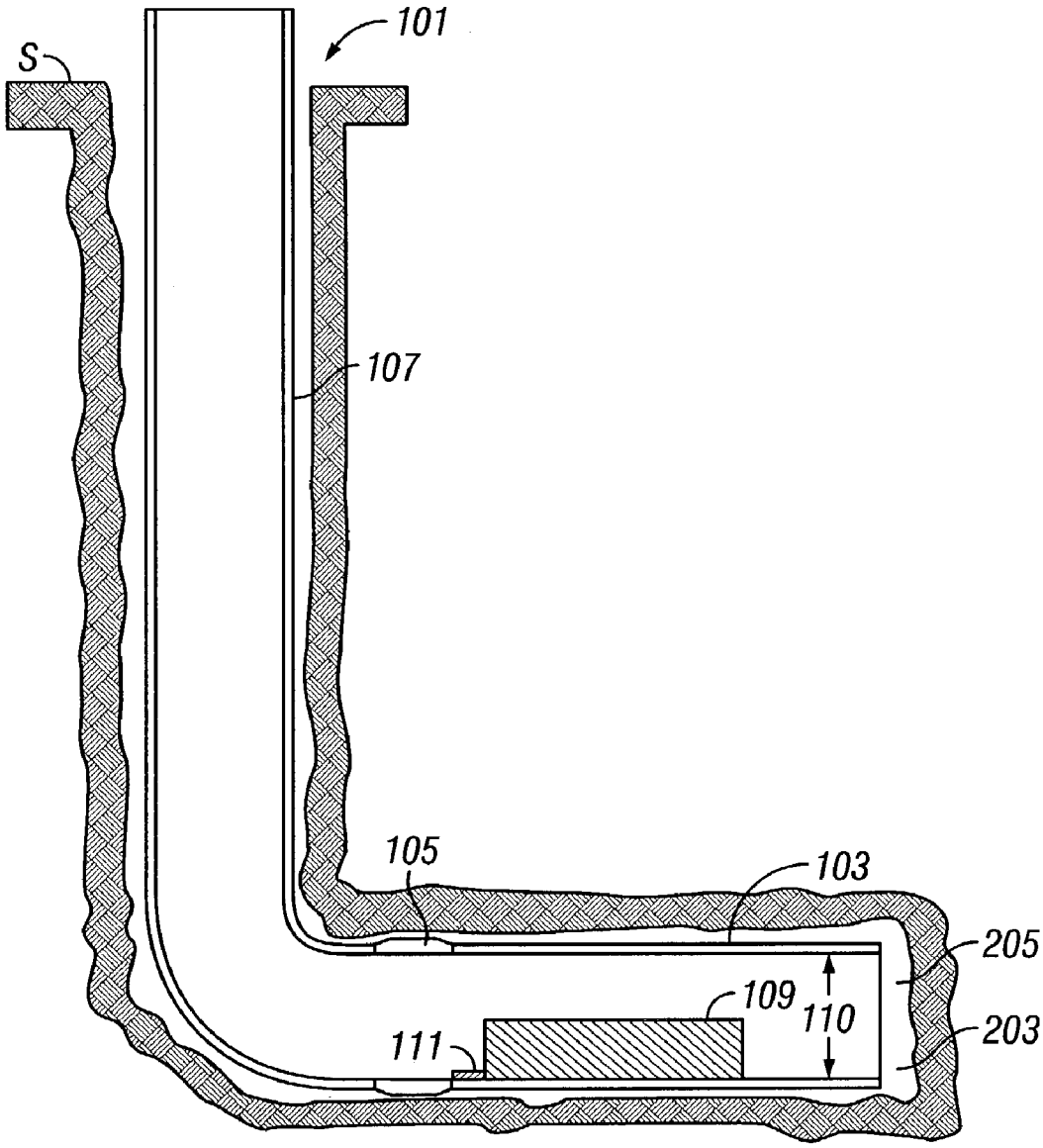
FIG. 1A is a sectional view of an example embodiment of the invention.
Figure 1B:
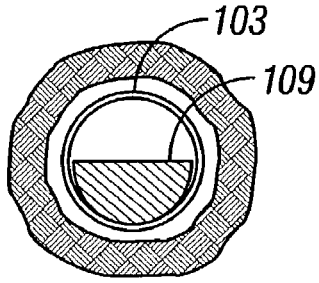
FIG. 1B is a sectional view of an example embodiment of the invention.

FIGS. 1A and 1B illustrate the basic principle of orienting a casing string 101 having a lower section 103. A casing swivel 105 is connected between an upper section 107 of casing string 101 and a slanted (or, in the illustrated example, horizontal) lower section 103, allowing lower section 103 to rotate with respect to upper section 107. An alignment weight 109 resides in the lower section 103 and comprises, in one embodiment, a semi-circular weight that is smaller than an inner diameter 110 of the lower section 103 of casing string 101. The alignment weight 109 causes the center of gravity of the longer section 103 to be off the rotational axis of the casing string 103. Therefore, the gravitational force causes the casing to be oriented.

In some embodiments, alignment weight 109 comprises a steel bar, cut in half, as seen in cross-section in FIG. 1B. In an alternative embodiment, alignment weight 109 comprises a hollow semi-circular container with a heavy material (e.g. lead, tungsten, etc.). In still further embodiments, alignment weight 109 comprises a part of the casing 103, integrally formed with the casing wall (e.g., by casting, forging, boring, or otherwise forming a casing section with an off-center bore (not shown)). In some specific examples, the alignment weight 109 is between about 25% to about 30% as long as the casing to be aligned.

In the example of FIG. 1A, alignment weight attachment 111 resides down-hole of casing swivel 105 and holds the alignment weight 109 in place. Design of the alignment weight attachment 111 is such that, once the casing section 103 is in position, in some embodiments, the alignment weight 109 is retrieved. In some such examples, the retrieving comprises retrieval with a drill pipe, tubing, coiled tubing, wireline, and/or other means for retrieving. In some examples, the retrieving is performed before cementing the casing in place, while, in other examples, the retrieving is done after cementing. Alignment weight attachment 111 is shown very generally in FIG. 1A and, in various examples, comprises numerous means for attaching. (for example, a shear screw, a snap latch, and/or other connectors). Latches typically used in slip-line work are used in some specific embodiments. Glues, tack welds, and any other means for attaching, are used in still further examples. Profiling the weight 109 (for example, a taper), in some examples, allows for fishing/jar tools to retrieve the weight 109. In one specific example, a tapered weight 109 is attached with a shear screw to lower section 103; and, to retrieve weight 109, a fishing tool slips over the taper, grasping the weight. Jarring actions shear the screw, and the weight is retrieved. Other means and methods for retrieval will occur to those of ordinary skill.

In still further examples, weight 109 is installed after the pipe or casing 103 is in a bore 205. In some such examples, weight 109 is latched in a profile or pocket in the inner surface of casing or tubing 103. For example, referring to FIGS. 6 lower section 103 of a casing to be oriented is seen having a weight 109 partially inserted in section 103. Since the casing section 103 is in the bore before weight 109 is inserted, a finger 601 is used to mate with curved slot 603 in casing 103. As weight 109 is fully inserted, finger 601 follows curved slot 603 and is latched at weight latch position 605 by any variety of latches that will occur to those of skill in the art. For example, see U.S. Pat. No. 6,012,527, incorporated herein by reference. Thus, weight 109 is oriented to casing 103. Upon latching of weight 109 to casing 103, gravity acts on weight 109 to orient casing 103.

Figure 7:
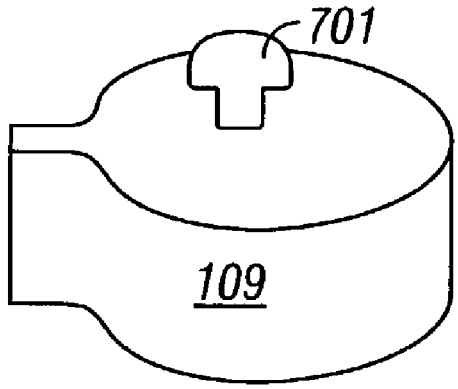
FIG. 7 is a perspective view of an example embodiment of the invention.

In some embodiments, a permanent latch is used to connect weight 109 to casing 103, and weight 109 is milled out of casing 103. In further embodiments, weight 109 (for example, FIG. 7), comprises a taper attachment 701, to which a detachable grapple (not shown) or other connector is used to install and/or remove weight 109. Such connectors are well-known to those of skill in the art and require no further explanation.

Figure 2A:
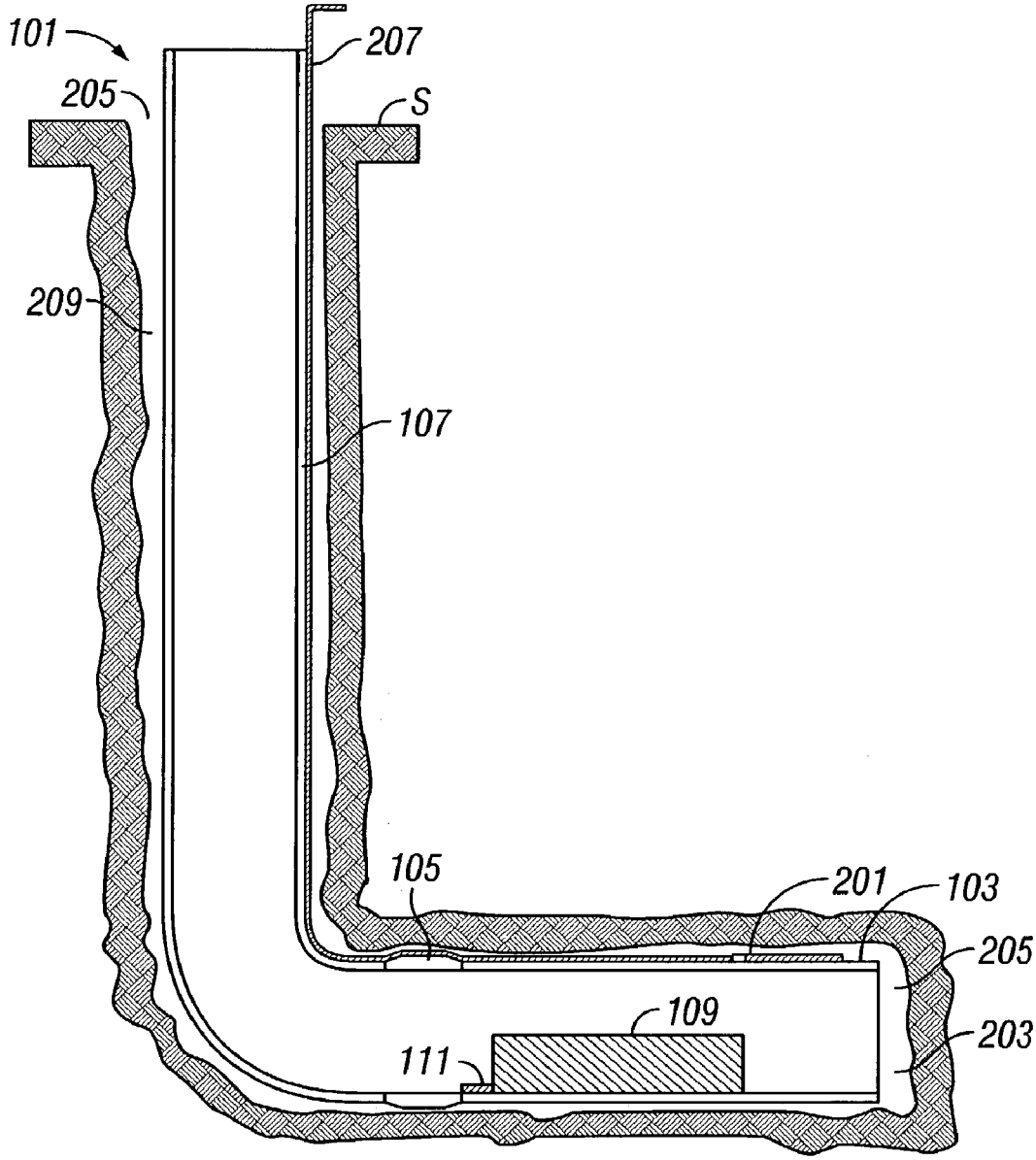
FIG. 2A is a sectional view of an example embodiment of the invention.
Figure 2B:
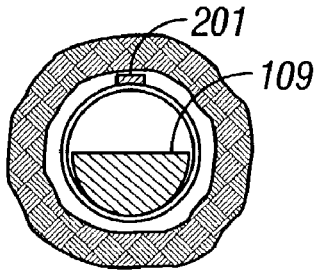
FIG. 2B is a sectional view of an example embodiment of the invention.

FIGS. 2A and 2B illustrate an example embodiment in which it is desirable to have instruments 201 on the upside of the lower section 103. Example instruments include well monitoring and control instruments (for example: pressure sensors, temperature sensors, particle velocity detectors, accelererometers, resistivity detectors, salinity detectors, acoustic instruments, multiphase flow sensors, radiation detectors, transmitters, receivers, devices used in intelligent or smart well completion, flow rate measurement devices, oil/water/gas ratio measurement devices, scale detectors, equipment sensors (e.g., vibration sensors), sand detection sensors, water detection sensors, data recorders, viscosity sensors, density sensors, bubble point sensors, pH meters, multiphase flow meters, acoustic sand detectors, solid detectors, composition sensors, resistivity array devices and sensors, acoustic devices and sensors, other telemetry devices, near infrared sensors, gamma ray detectors, $H_2S$ detectors, $CO_2$ detectors, downhole memory units, downhole controllers, locators, electronic tags, etc.) In addition, a control line itself may comprise a monitoring instrument as in the example of a fiber optic line that provides functionality (e.g., temperature measurement, pressure measurement, etc). In at least one example, the fiber optic line provides a distributed temperature functionality to allow the temperature along the length of the fiber optic line to be determined.

In some specific embodiments, at the surface S, the alignment weight attachment 111 is placed just down-hole of the casing swivel 105, and the instruments 201 are attached in a predetermined location on the lower section 103. The attaching of the instruments 201 to the lower section 103 is accomplished, in a variety of embodiments, by welds, snaps, integral formation in the casing section 103, and/or any other method or means of attaching instruments to a casing.

In at least some examples, the alignment weight 109 is inserted in the casing and oriented in relation to the sensors 201, such that the alignment weight 109 will be on a low side 203 of the hole 205 when instruments 201 are in the correct position. An instrument line 207 is positioned outside of the casing 101, in the illustrated example, up to the surface S for providing, in various embodiments, power, data, and/or control communication, with instruments 201. As the lower section 103 of the casing string 101 begins to leave the vertical section 209 of the hole 205, the alignment weight 109 causes the lower section 103 to rotate the instruments 201 to the predetermined position (in this case, on the topside); thus, a gravity orientation is achieved.

In a still further embodiment, the portion 107 of the string 101 in the vertical portion 209 of the hole 205 (above the casing swivel 105) is aligned by rotating the casing 101.

Figure 2C:
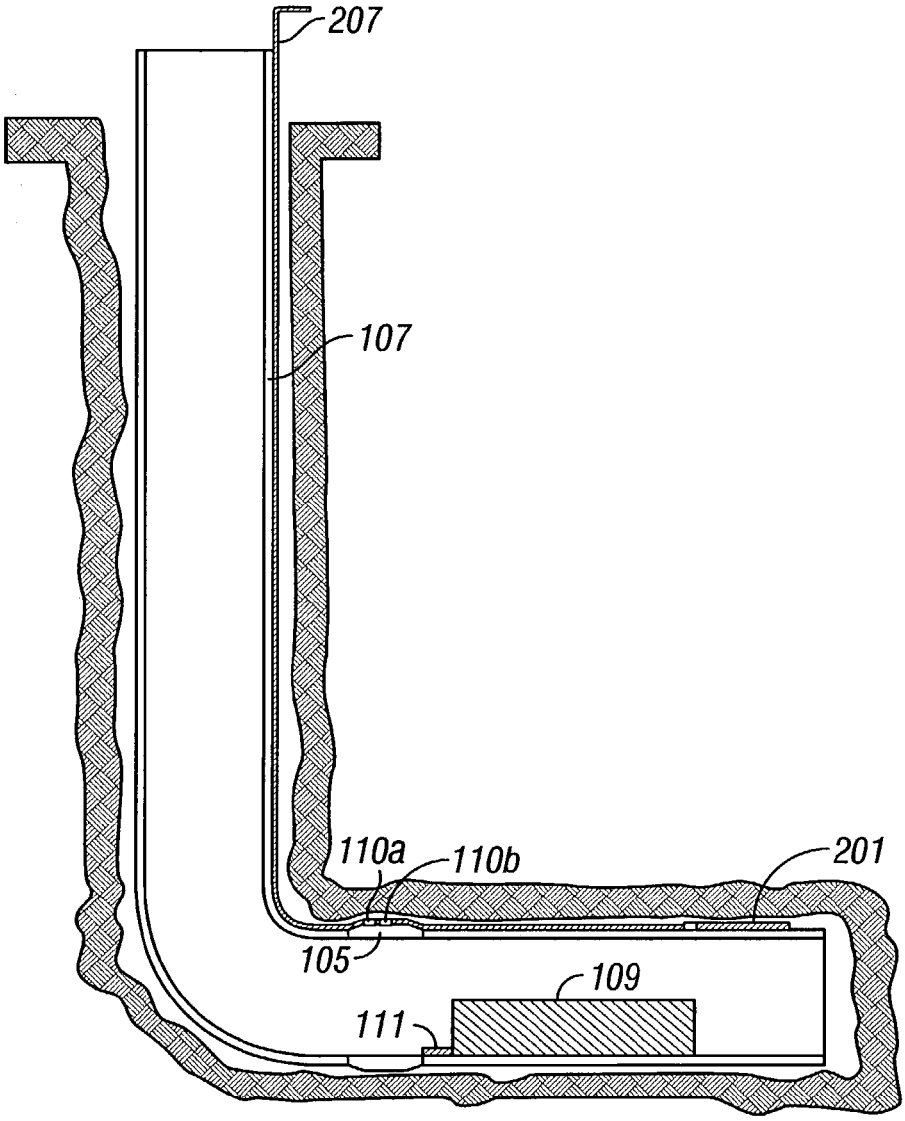
FIG. 2C is a sectional view of an example embodiment of the invention.
Figure 3A:
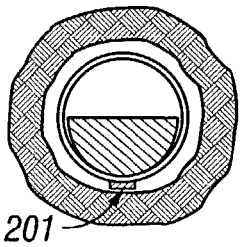
FIG. 3A is a sectional view of an example embodiment of the invention.
Figure 3B:
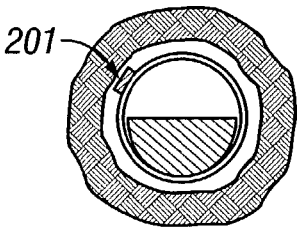
FIG. 3B is a sectional view of an example embodiment of the invention.
Figure 3C:
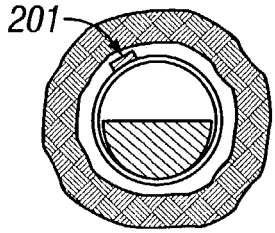
FIG. 3C is a sectional view of an example embodiment of the invention.
Figure 3D:
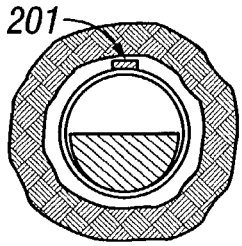
FIG. 3D is a sectional view of an example embodiment of the invention.

In at least one example, illustrated in FIG. 2C, instrument line 207 comprises line couplers 110*a* and 110*b*. In some embodiments, line couplers 110*a* and 110*b* comprise optical couplers. In some alternate embodiments, line couplers 110*a* and 110*b* comprise inductive couplers. Other means for line coupling, not having a wired connection that would twist around casing string 101 when the lower section 103 or the upper section 107 rotate, are used in still further embodiments. In still yet further embodiments, combinations of sensors and other instruments are used, and multiple lines 207 reside outside casing string 101. In still yet further alternate embodiments, combinations of sensors and other instruments reside in an inset (not shown) in the casing wall and/or are embedded in the casing wall.

Referring now to FIGS. 3A–3D, in a variety of specific embodiments, the sensors 201 are aligned in any direction by orienting the sensors 201 relative to the alignment weight 109 at the surface S before running the string 101 in the well or by installing weight 109 in section 103 after section 103 is in bore 205 but before cementing.

In some embodiments, rather than (or, in addition to) direct orientation of instruments 201, attributes of lower section 103 are oriented to alignment weight 109. Some lower sections 103 include index indicators (e.g., markings, slots, etc.) or other attributes on the inner surface of the casing, and it is desirable to orient such casing attributes for a variety of reasons. For example, tools and liners (which, themselves, may include instruments and/or tools) run into the casing 103 are oriented with respect to the attributes of the casing 103 in some embodiments. Such orientation is sometimes referred to herein as "attribute orientation" to distinguish it from gravity orientation, described above. In such a case, a rotating force is applied to the tool, or a tubing, until alignment with an attribute is achieved.

Figure 6:
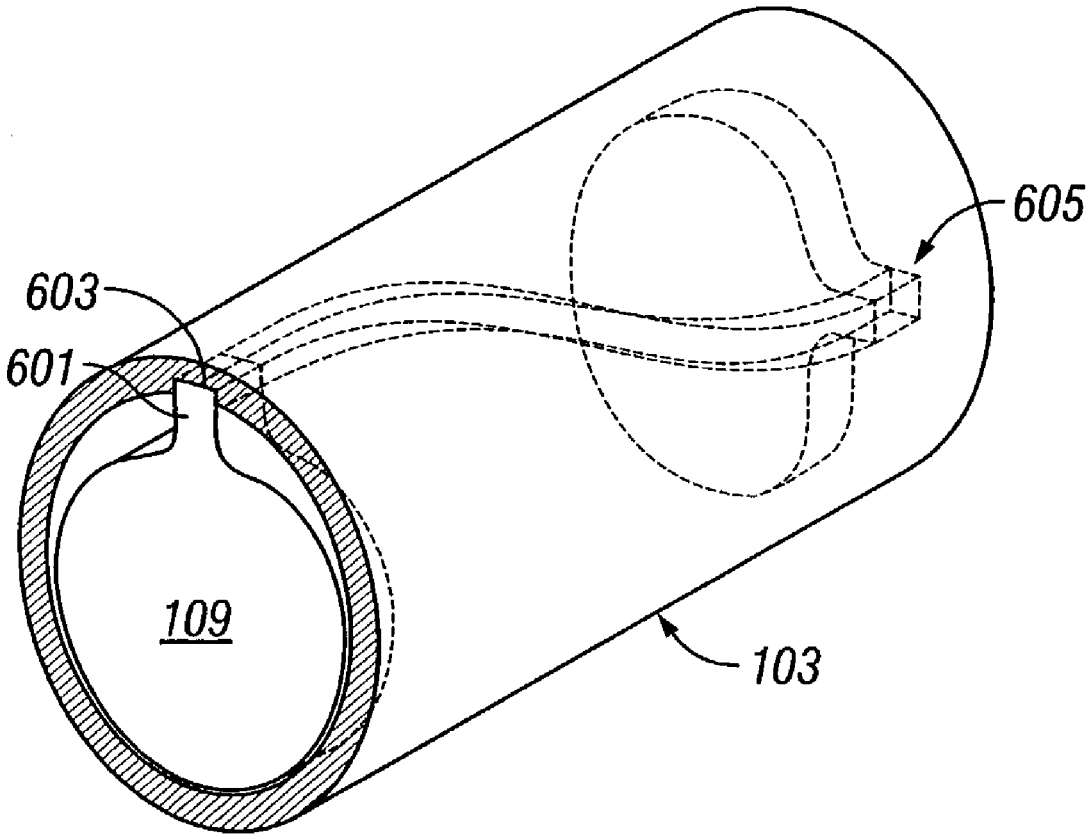
FIG. 6 is a perspective view of an example embodiment of the invention.

In some cases, the alignment is mechanical (e.g., a protrusion locking into a slot, an example of which is seen in FIG. 6); and, in other embodiments, the alignment is through correlation of signals (e.g., magnetic and/or electric field variations) as rotation occurs. Visual indications (e.g., reflection changes in the side-wall of the casing as a light source attached to the rotating tubing illuminates portions of the side-wall) comprise further embodiments. In some examples, the rotating force is applied at the surface to an upper section of tubing (e.g., by a rotary table from a traditional rig); however, in some alternative examples, the rotating force for attribute orientation is applied by gravity pulling on an off-axis center of gravity of the tool or tubing until alignment with an index is achieved. Applying the rotating force through the use of gravity in attribute orientation is simple; however, it is best suited to applications in which the chance of needing to rotate more than a few degrees from vertical is low.

In further embodiments, once the attributes are oriented, in later operations, tools and other items run in the casing are oriented with respect to the casing attributes.

In at least one specific example, a perforation tool is run in the casing string 101 and oriented to a casing attribute (for example, an indexing indicator, e.g.: a groove in lower section 103) or by gravity. The perforation tool is thus accurately oriented with the casing and any sensors or other instrumentation on the outside of the casing. In this manner, damage to the sensors by perforation is avoided.

As a result of the accurate orientation of the instruments on the outer casing and the orienting of the perforation tool in the casing, a method of well completion is thus provided in which a casing portion 103, including instruments 201 in communication with the surface S and attached to the outside of casing 103, is oriented (e.g., by gravity) and fixed in place (e.g., by conventional cementing). A perforation tool is run inside casing portion 103 and oriented (e.g., by gravity-orientation, by reference to a casing attribute, or by some other method or means of orienting a tool in a casing), and the casing is perforated. Because of the accurate alignment of the perforation tool and the instruments, damage to the instruments is avoided. The perforation tool is then removed and production continues after perforation without interruption; there is no need to halt production after perforation to install instruments in the well. They are efficiently installed in a perforation zone as the casing is installed. The above is merely one example of a method of use of casing tools in conjunction with oriented instruments on the outside of an installed and oriented casing, wherein the method comprises: installation of the casing having instruments attached thereto, orienting the casing, and orienting the tool in the casing.

Figure 4A:
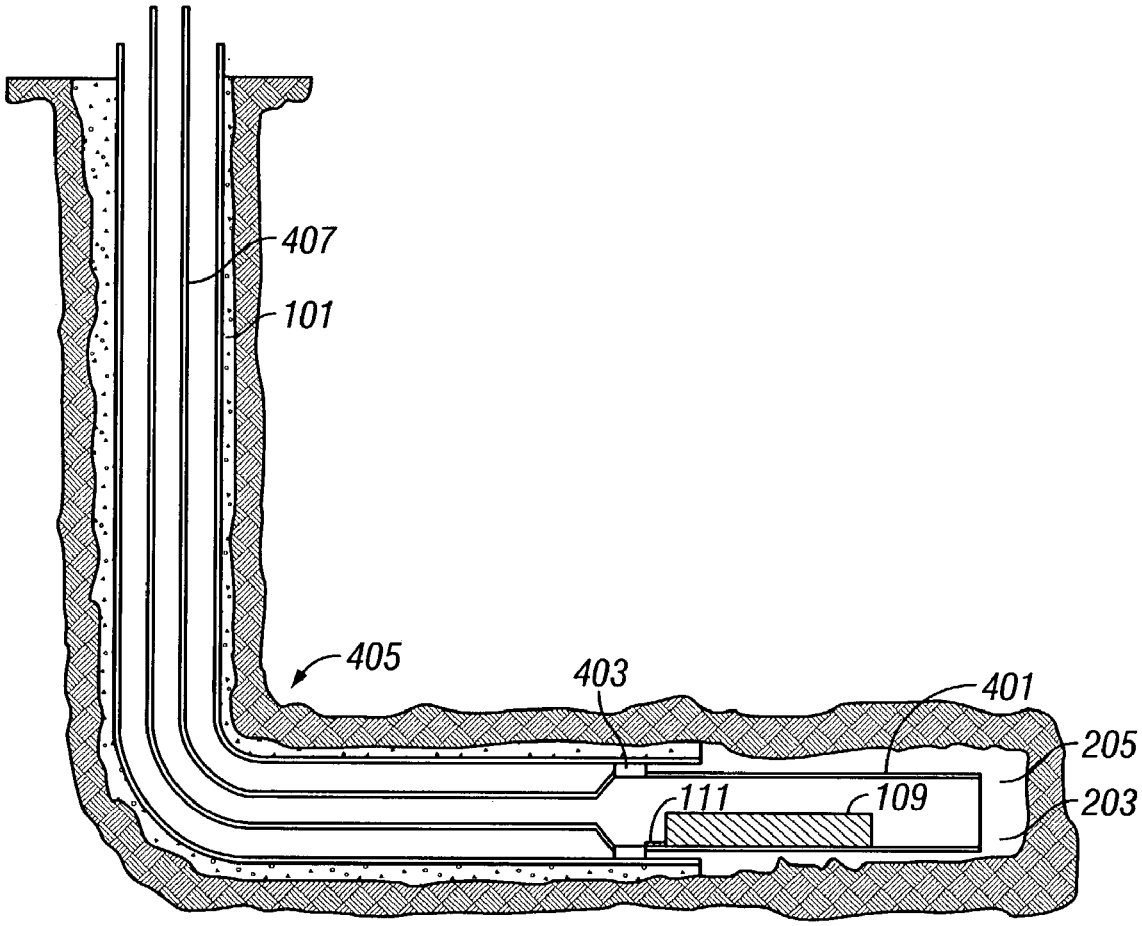
FIG. 4A is a sectional view of an example embodiment of the invention.
Figure 4B:
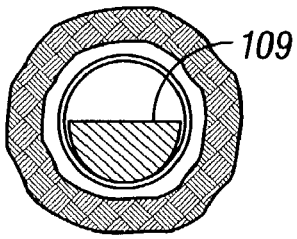
FIG. 4B is a sectional view of an example embodiment of the invention.

The examples described above have further application with respect to liners, and FIGS. 4A and 4B illustrate an example embodiment of the invention for aligning or orienting a liner 401 inside a cemented casing string 101 (which may or may not have, itself, been aligned). Alignment weight attachment 111 is run down-hole of a liner-hanger setting-tool 403 that comprises a swivel (not seen). Alternatively, a separate casing swivel is run between a liner-hanger and the alignment weight attachment 111. As in orientation of a casing string, the orienting of liner 401 is accomplished by allowing rotation, such that the alignment weight 109 is on the low side 203 of the hole 205 as the liner 401 goes past the curve 405. When the liner 401 reaches depth, a work string 407 is used to set the liner hanger 403 and release the work string 407 from the liner 401 (e.g., by methods that are well understood and require no further elaboration). The work string 407 is then attached to the alignment weight 109 which is then unlocked from the alignment weight attachment 111. As the work string 407 is removed from the bore 205, work string 407 retrieves the alignment weight 109. The liner 401 is then fixed (e.g., by cementing) in place using conventional techniques, according to at least one embodiment.

Figure 5A:
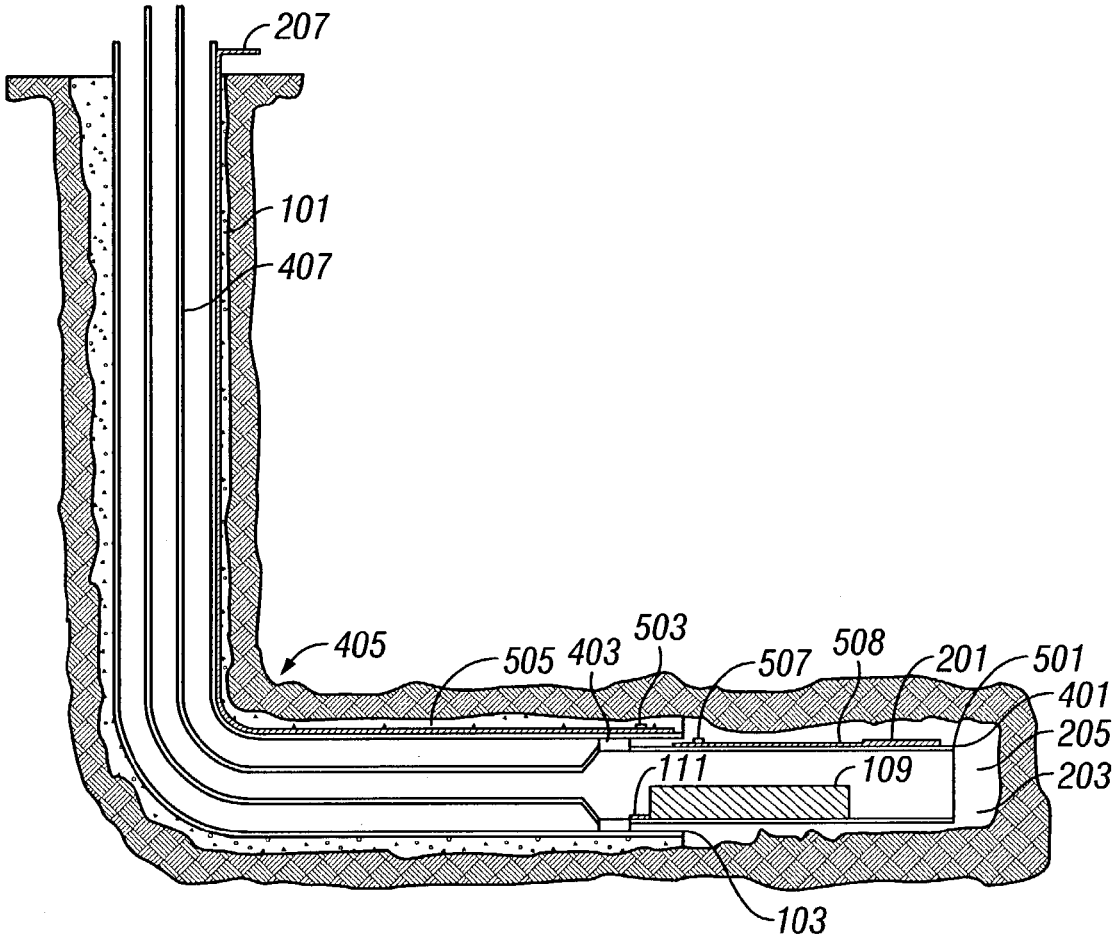
FIG. 5A is a sectional view of an example embodiment of the invention.
Figure 5B:
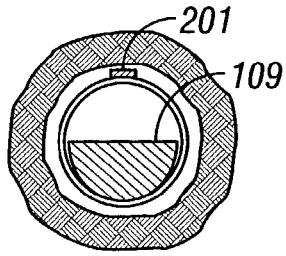
FIG. 5B is a sectional view of an example embodiment of the invention.

Illustrated in FIGS. 5A and 5B is a combination of several of the example embodiments previously described. It is desirable to place sensors 201 near the bottom 203 of a bore 205 (for example, on the outside 501 of a liner 401). The sensors 201 are to be oriented such that they are not damaged when the liner 401 is perforated and for various other reasons. According to at least one embodiment, therefore, the casing string 101 is run in with a transmitter/receiver 503 located in a particular orientation (for example, on the top side 505 of the casing string 101 in the area where the upper end 507 of the liner and the lower end 103 of the casing overlap, sometimes called the "liner lap"). Communication to the surface is accomplished via a line 207 (e.g., wire, fiber optic, etc.) attached to the outside of the casing 101. A configuration similar to that shown in FIGS. 2A and 2D is used in some embodiments. Once the lower end 103 of the casing 101 is in position, the alignment weight 109 is retrieved. The transmitter/receiver 503 and cable 207 are fixed in the well 205 along with the casing 101 using, for example, conventional cementing techniques. The well is then drilled further until an appropriate point for the setting of the next liner or the well is complete.

The desired instruments 201 are attached to a liner 401 and a cable 508 is run along the outside 501 of the liner 401 to a spot that will be in the liner lap and substantially below the transmitter/receiver 503 (or at least in signal communication with transmitter/receiver 503). Transmitter/receiver 507 is installed on the outside 501 of liner 401, and an alignment weight attachment 111 is installed in the top of the liner 401. Alignment weight 109 is placed in the liner 401 and oriented such that, when it is on the low side 203 of the well 205, the transmitter/receiver 507 is in communication with transmitter/receiver 503 on the casing 101. Above the alignment weight attachment 111, a liner-hanger and a liner-hanger setting-tool 403 with a built-in swivel are installed. As before, in some embodiments, a liner hanger is used without a built-in swivel, and a casing swivel is installed between a setting tool and an alignment weight attachment.

When the string goes around the corner 405 from vertical to horizontal, the liner 401 rotates such that the alignment weight 109 is on the lower side 203 of the bore 205 and the transmitter/receivers 503 and 507, the cable 508, and the instruments 201 will be on the top side of the bore 205. This will position them such that, when they arrive at depth, the transmitter/receiver 507 on the liner 401 will be lined up with the transmitter/receiver 503 on the casing 101.

In an alternative embodiment, the casing comprises an expandable tubing section. As used herein an expandable tubing section comprises a length of expandable tubing. The expandable tubing may be a solid expandable tubing, a slotted expandable tubing, an expandable sand screen, or any other type of expandable conduit. Examples of expandable tubing are known. For example, see the expandable slotted liner type disclosed in U.S. Pat. No. 5,366,012, issued Nov. 22, 1994 to Lohbeck, the folded tubing types of U.S. Pat. No. 3,489,220, issued Jan. 13, 1970 to Kinley, U.S. Pat. No. 5,337,823, issued Aug. 16, 1994 to Nobileau, U.S. Pat. No. 3,203,451, issued Aug. 31, 1965 to Vincent, the expandable sand screens disclosed in U.S. Pat. No. 5,901,789, issued May 11, 1999 to Donnelly et al., U.S. Pat. No. 6,263,966, issued Jul. 24, 2001 to Haut et al., PCT Application No. WO 01/20125 A1, published Mar. 22, 2001, U.S. Pat. No. 6,263,972, issued Jul. 24, 2001. All of the above patents are incorporated herein by reference.

As used in the present discussion, the term casing and liner are interchangeable and casing is used generically to refer to both casings and liners.

The above examples have consistently shown the instruments aligned on the top of the liner or casing merely as one example. In other embodiments, cables and instruments are on the sides and/or bottom of the casing or liner. Also, the examples have been given with respect to a substantially horizontal well; however, various embodiments of the invention are equally applicable in slanted wells. For example, see U.S. Pat. No. 6,012,527, incorporated herein by reference.

Although only a few exemplary embodiments have been described in detail above, those skilled in the art will readily appreciate that many modifications are possible without materially departing from the teachings or advantages of this invention. All such modifications are intended to be included within the scope of the invention as defined in the following claims. Means-plus-function clauses are intended to cover the structures described herein and not only the structural equivalents, but also functionally-equivalent structures. It is the express intention of the applicant not to invoke 35 U.S.C. Section 112, paragraph 6, for any limitations of any of the clause not expressly using the phrase "means for" together with a function.

What is claimed is:

1. A system for orienting a portion of conduit in a non-vertical wellbore, the system comprising:

an elongated conduit having a conduit portion for orienting in the wellbore;

a weight detachably connected to an inner surface of the conduit portion offsetting the center of gravity of the conduit from its rotational axis.

2. The system of claim 1, wherein the weight includes a fishing tool connection.

3. The system of claim 2, further including an instrument connected to the conduit portion outside of the bore of the conduit portion.

4. The system of claim 2, wherein the fishing tool connection is a taper.

5. The system of claim 4, further including an instrument connected to the conduit portion outside of the bore of the conduit portion.

6. The system of claim 1, wherein the weight is attached to the inner surface by a shear screw.

7. The system of claim 6, further including an instrument connected to the conduit portion outside of the bore of the conduit portion.

8. The system of claim 1, wherein the weight is attached to the inner surface by a snap latch.

9. The system of claim 8, further including an instrument connected to the conduit portion outside of the bore of the conduit portion.

10. The system of claim 1, wherein the weight is attached to the inner surface by a finger extending from the weight inserted in a slot formed by the inner surface.

11. The system of claim 10, further including an instrument connected to the conduit portion outside of the bore of the conduit portion.

12. The system of claim 1, further including an instrument connected to the conduit portion outside of the bore of the conduit portion.

13. The system of claim 12, wherein the instrument is attached to the conduit portion by a weld.

14. The system of claim 12, wherein the instrument is attached to the conduit portion by a snap.

15. The system of claim 12, wherein the instrument is integrally formed in the conduit portion.

16. A method of orienting a portion of a conduit in a non-vertical wellbore, the method comprising the steps of:

providing an elongated conduit having a conduit portion for orienting in the wellbore, running the conduit into the wellbore; and orienting the conduit portion in the wellbore by detachably connecting a weight to an inner surface of the conduit portion offsetting the center of gravity of the conduit from its rotational axis.

17. The method of claim 16, further including the step of:

fixing the conduit portion in the wellbore.

18. The method of claim 17, wherein the step of fixing comprises cementing the conduit portion in the wellbore.

19. The method of claim 17, farther including the step of:

connecting an instrument to the conduit portion outside of the bore of the conduit portion.

20. The method of claim 19, further including the steps of:

orienting a perforation tool in the conduit portion; and perforating the conduit portion.

21. The method of claim 17, further including the steps of:

orienting a perforation tool in the conduit portion; and perforating the conduit portion.

22. The method of claim 16, further including the step of:

connecting an instrument to the conduit portion outside of the bore of the conduit portion.

23. The method of claim 22, further including the steps of:

orienting a perforation tool in the conduit portion; and perforating the conduit portion.

24. The method of claim 16, further including the steps of:

orienting a perforation tool in the conduit portion; and perforating the conduit portion.

25. The method of claim 16, wherein the weight includes a fishing tool connection.

26. The method of claim 25, wherein the weight is detachably connected to the inner surface of the conduit portion before the step of running the conduit in the wellbore.

27. The method of claim 25, wherein the weight is detachably connected to the inner surface of the conduit portion after the step of running the conduit in the wellbore.

28. The method of claim 16, wherein the weight is detachably connected to the inner surface of the conduit portion before the step of running the conduit in the wellbore.

29. The method of claim 28, wherein the weight is attached to the inner surface by a finger extending from the weight inserted in a slot formed by the inner surface.

30. The method of claim 16, wherein the weight is detachably connected to the inner surface of the conduit, portion after the step of running the conduit in the wellbore.

31. The method of claim 30, wherein the weight is attached to the inner surface by a finger extending from the weight inserted in a slot formed by the inner surface.

32. The method of claim 16, wherein the weight is attached to the inner surface by a finger extending from the weight inserted in a slot formed by the inner surface.

33. The method of claim 16, further including the steps of:

connecting an instrument to the conduit portion outside of the bore of the conduit portion;

fixing the conduit portion in the wellbore;

removing the weight from the conduit portion;

orienting a perforation tool in the conduit portion, and perforating the conduit portion.

34. The method of claim 33, wherein the weight is detachably connected to the inner surface of the conduit portion before the step of running the conduit in the wellbore.

35. The method of claim 34, wherein the weight is attached to the inner surface by a finger extending from the weight inserted in a slot formed by the inner surface.

36. The method of claim 33, wherein the weight is detachably connected to the inner surface of the conduit portion after the step of running the conduit in the wellbore.

37. The method of claim 36, wherein the weight is attached to the inner surface by a finger extending from the weight inserted in a slot formed by the inner surface.

38. The method of claim 33, wherein the weight is attached to the inner surface by a finger extending from the weight inserted in a slot formed by the inner surface.

* * * * *